US006530869B2

(12) United States Patent
Bluemle

(10) Patent No.: US 6,530,869 B2
(45) Date of Patent: Mar. 11, 2003

(54) METHOD AND APPARATUS FOR THE PRODUCTION OF MAILING BAGS INCLUDING ENVELOPES

(75) Inventor: Martin Bluemle, Horhausen (DE)

(73) Assignee: Winkler + Duennebier AG, Neuwied (DE)

( * ) Notice: Subject to any disclaimer, the term of this patent is extended or adjusted under 35 U.S.C. 154(b) by 4 days.

(21) Appl. No.: 09/767,372

(22) Filed: Jan. 22, 2001

(65) Prior Publication Data

US 2001/0023226 A1 Sep. 20, 2001

(30) Foreign Application Priority Data

Jan. 21, 2000 (DE) ..... 100 02 543

(51) Int. Cl.[7] ..... B31C 11/04

(52) U.S. Cl. ..... 493/279; 493/210; 493/256; 493/379; 493/917

(58) Field of Search ..... 493/210, 220, 493/222, 256, 257, 379, 382, 917, 919

(56) References Cited

U.S. PATENT DOCUMENTS 3,412,655 A * 11/1968 Kranz ..... 493/344
3,887,414 A * 6/1975 Cohn ..... 156/108
4,765,117 A * 8/1988 Akutsu et al. ..... 156/519
5,584,163 A * 12/1996 Storandt ..... 493/210
5,816,993 A * 10/1998 Fowler et al. ..... 493/221
5,827,166 A * 10/1998 Cestonaro et al. ..... 156/504
6,210,308 B1 * 4/2001 Wild et al. ..... 493/197
6,267,714 B1 * 7/2001 Wild et al. ..... 493/11

* cited by examiner

*Primary Examiner*—Rinaldi I. Rada
*Assistant Examiner*—Hemant M. Desai
(74) *Attorney, Agent, or Firm*—W. F. Fasse; W. G. Fasse

(57) ABSTRACT

In a method for the production of mailing bags, including envelopes, from material in web form, the material is processed in numerous ways and at least two separately prepared parts are transported to a joining station and there joined to one another with an adhesive. The two parts, at least one of which is already provided with the necessary adhesive, are placed one upon the other during an arcuate movement and joined to one another, in order to increase the speed of production. Particularly, at least one of the two parts (6, 7) and/or its carrier, performs an undulating movement in the region of the joining station (5).

24 Claims, 3 Drawing Sheets

METHOD AND APPARATUS FOR THE PRODUCTION OF MAILING BAGS INCLUDING ENVELOPES

FIELD OF THE INVENTION

The invention relates to a method and an apparatus for the production of mailing bags, including envelopes, from material in web form which is processed in numerous ways with the aid of a plurality of method steps and, accordingly, in a plurality of workstations.

BACKGROUND INFORMATION

For the above purpose, the material in web form is trimmed at its edges and cut through, provided with adhesive, folded and bonded. In special cases, a second, flat part such as, for example, a cut-to-size window piece, a sticker, an adhesive-masking strip or another, additional part forming the mailing bag or the envelope blank is additionally fixed with the aid of adhesive directly to the material in web form or to a cut-to-size piece or blank. The technical effort involved therewith is great and, in particular, causes a problem when the aim is significantly to increase the number of mailing bags or envelopes to be produced per unit of time.

SUMMARY OF THE INVENTION

It is therefore an object of the invention to indicate method steps and the associated apparatus whereby it is possible to increase the number of units per unit of time in the production of mailing bags, including envelopes, which consist not merely of one part but of at least two, initially separate parts.

In order to achieve the stated object, the invention provides a method of producing mailing bags from two parts that are joined to each other with an adhesive in a joining station, wherein at least one of the parts is provided with the adhesive, and then the two parts are placed in contact with one another during an arcuate movement thereof. Especially according to the invention, at least one of the two parts and/or its carrier performs an undulating movement in the region of the junction station. The actual contact and junction station is only minimally larger than a linear contact surface. Its curvature and position are predetermined by the curvature of the suction roller serving as an applicator roller. Immediately adjoining the actual contact station, the curvature of at least one of the two parts and/or its carrier is directed counter to the curvature of the applicator roller and then makes an immediate transition into a preferably common plane. The respective arcuate pieces are extremely short.

The guidance and handling of the two parts during superposition and bonding is, in the stated manner, simpler than previously, in particular because virtually no belt tensions caused by the curvature arise and also because, as a rule, only one of the two parts to be joined to one another has to be bent to conform to the curvature of the applicator roller. At least one of the two parts therefore runs in a virtually linear manner through the contact and junction station and is nevertheless guided with minimum undulation. The consequence of this is that larger numbers of units than previously can be achieved per unit of time.

For the performance of the method according to the invention, provision is further made for at least one of the two parts and/or its carrier, at the junction station, initially to move convexly into a trough and then concavely through the trough and finally convexly again out of the trough. The respective arcuate pieces are extremely short and therefore cause not a pronounced but only a minimal curvature. In order to achieve this, the trough according to the invention is only shallow and may possess a maximum depth of, for example, 1.5 mm to 2 mm.

BRIEF DESCRIPTION OF THE DRAWINGS

The invention is described in more detail below with reference to an example of embodiment which is shown in the drawing, in which.

DETAILED DESCRIPTION OF THE INVENTION

Figure 1:
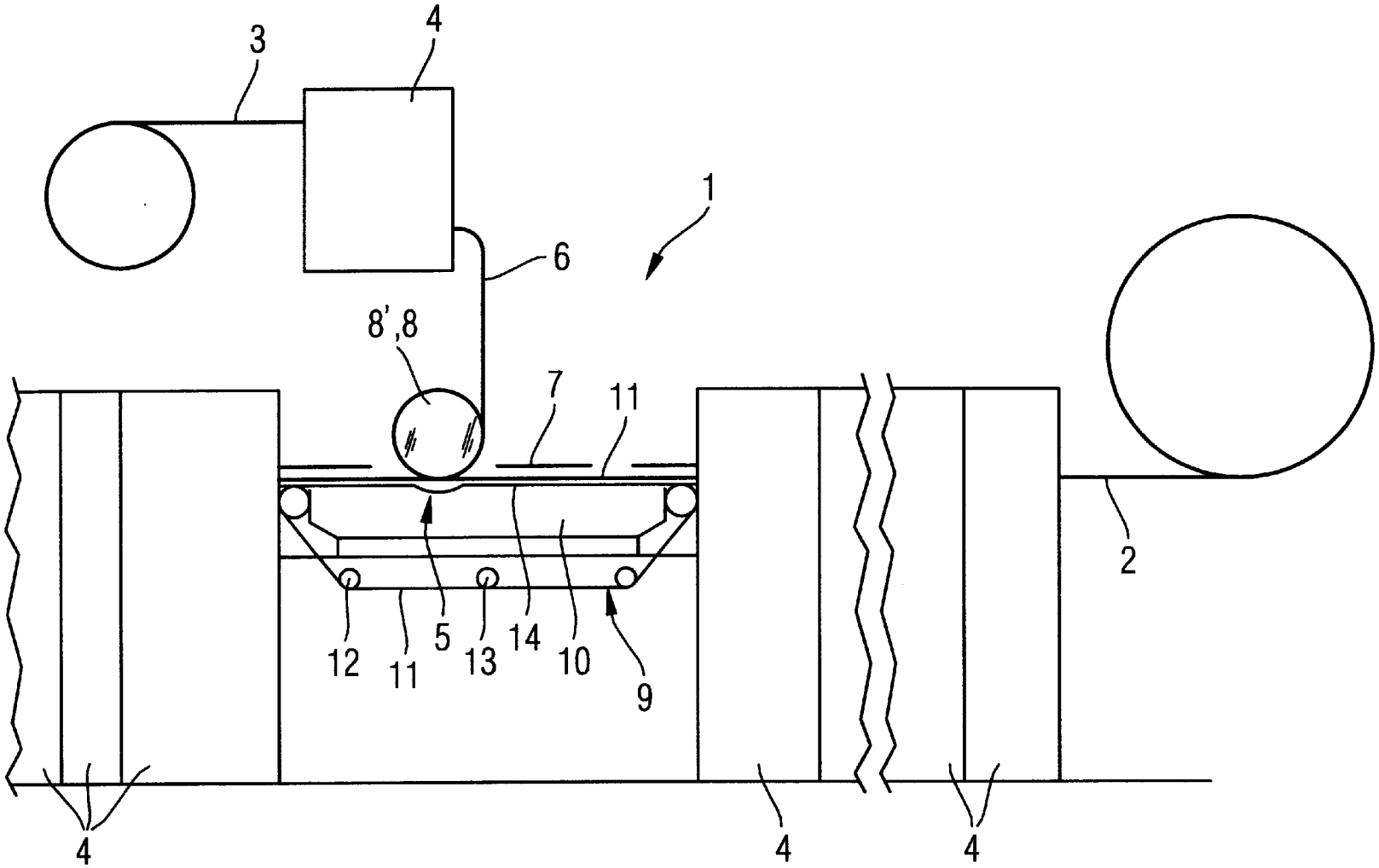
FIG. 1 shows a basic diagram of an apparatus for the production of mailing bags including envelopes.

An apparatus 1 for the production of mailing bags including envelopes from material 2 and 3 in web form comprises a plurality of structural groups 4, in which the material 2, 3 is processed in numerous ways. To this end, it is cut to size, provided with provisional breaking points, folded, provided with glue and assembled to form the finished product. In the production of various mailing bags, and also of various envelopes, it is necessary, at one or more junction stations 5, to fix two separately prepared parts 6, 7 to one another or join them to one another with the aid of adhesive. The two parts 6, 7 may, for example, be a cut-to-size window piece in one case and a cut-to-size envelope piece in the other and/or different, previously separated parts or material that is still in web form and has not yet been cut into individual parts. The essential thing is that a part already provided with adhesive and a further part are brought together at the junction station 5 of the apparatus 1 and are then joined to one another in the contact region under adequate contact pressure.

At the junction station 5, a suction device 8 is located as a carrier for one part 6. According to an example embodiment, the suction device 8 is a suction roller 8' serving as an applicator roller.

A conveyor device 9 having at least one belt serves in the region of the junction,station 5 as a carrier for the other part 7. It conveys the part 7 to the junction station 5, through the latter and then away from it. According to an example embodiment, the conveyor device 9 is a conveyor device operating under vacuum and having at least one suction belt.

The suction belt conveyor device 9 comprises a suction box and additionally has conveyor belts 11 arranged at a distance apart, together with deflection rollers 12 and a device 13 for tensioning the conveyor belts 11.

However, the suction belt conveyor device 9 serves not only as a carrier for one part 7 but also as a countertool for the suction roller 8'. The suction roller 8' for its part conveys the other part 6 to the junction station 5 and retains and guides it there. It simultaneously has the function of a bonding cylinder.

Figure 4:
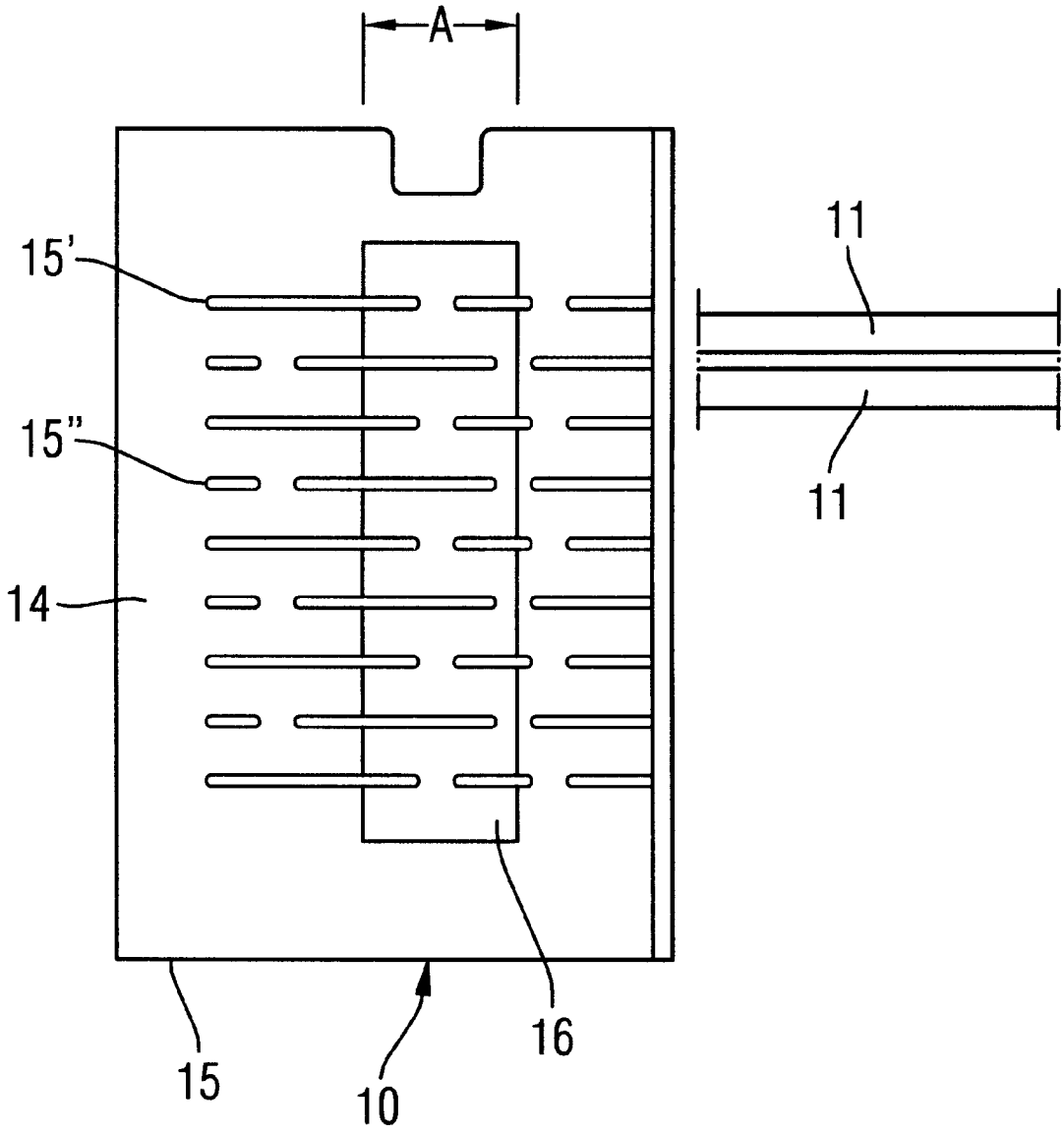
FIG. 4 shows a plan view of the suction box on a different scale.

The suction box 10 has, in its top 14 facing the conveyor belts 11, suction apertures or slits 15' and 15" arranged parallel to one another and known in principle (FIG. 4).

Figure 2:
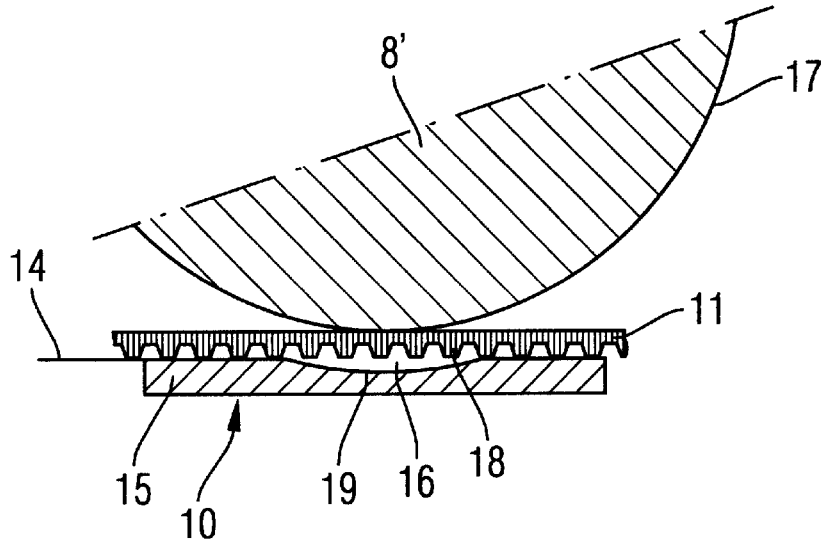
FIG. 2 shows, in section, a detail of FIG. 1 on a larger scale and in the position of rest without parts to be connected.
Figure 3:
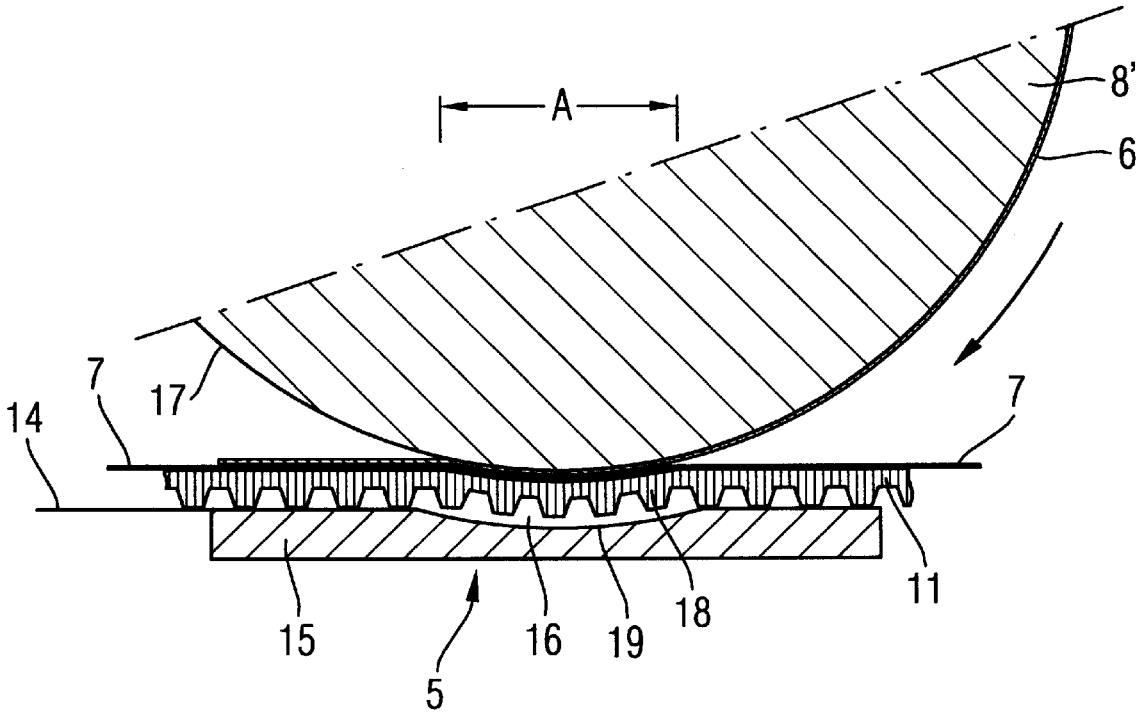
FIG. 3 shows a section as in FIG. 2 of a further enlarged scale in an operating state with parts to be connected.

Furthermore, a recess or cut-out or trough 16 is located in the top 14 or in the cover plate 15 forming this top. In the state of rest or without the parts 6 and 7, the conveyor belts 11 lie directly on the cover plate 15. They are prestressed under a constant force, extend in a linear manner over the cover plate 15 and tangentially touch the circumference 17 of the suction roller 8'. In this operating state (state of rest without parts 6 and 7) the conveyor belts 11 do not dip into the trough 16, so that their teeth 18 are located at a significant distance above the trough bottom 19 (FIG. 2). If, however, according to FIG. 3, the suction roller 8' conveys a part 6 and similarly the conveyor belts 11 convey a part 7 into the trough region or through the junction station 5, the conveyor belts 11 are pressed into the trough 16 to an extent corresponding to the material thickness of the two parts 6 and 7 (FIG. 3) In his situation also, the teeth 18 of the conveyor belts 11 do not touch the trough bottom 19.

During joining, the parts 6 conveyed along the contour or along the circumference 17 of the suction roller 8' encounter, at an acute angle, the parts 7 which for their part, because of their material thickness, are likewise moving at an acute angle to the circumference 17 of the suction roller 8'. The parts 7 do not tangentially encounter the parts 6 at the start of the junction station 5. As a result they are initially diverted convexly towards the trough and then move concavely relative to the trough 16. During the direct contact between the two parts 6, 7, they briefly move along an arcuate stretch corresponding to the contour of the suction roller 8'. Fundamentally the same thing applies to the movement of the conveyor belts 11.

During the bringing-together and joining of the two parts 6, 7, the conveyor belts 11, not directly supported on the contact station, simultaneously serve as a contact-pressure tool or a counter-tool for the suction roller 8'. Along a short arcuate piece and for a brief period the conveyor belts 11 together with the two parts 6 and 7 curve around the suction roller 8'. At this time, the conveyor belts 11 initially move convexly to the trough 16 and then concavely along the trough 16 and finally convexly again to the trough 16. The conveyor belts 11 dip somewhat arcuately and concavely into the trough 16. As a result of the belt tension, the parts 6 and 7 are at the same time pressed against one another under constant force.

The trough 16 is shallow. It has the cross-sectional shape of a segment of a circle or approximately the segment of a circle (FIG. 2). The contour of the trough 16 is expediently curved parallel to the circumference 17 of the suction roller 8'. The maximum depth of the trough 16 opposite the top 14 of the suction box 11 carrying the conveyor belts 11 is approximately 1.5 to 2 mm. An essential point is that the conveyor belts 11 also do not contact the trough bottom 19 in the operating state according to FIG. 3.

Finally, it is expedient if the length A of the trough 16 in the direction of movement of the conveyor belts 11 is significantly shorter than the measurement for the diameter of the suction roller 8'.

The invention is not restricted to a particular case of application. The parts 6 and 7 may be individual parts or material in web form.

Instead of a plurality of conveyor belts 11 the suction belt conveyor device 9 may also have a single, broad suction belt with suction holes and, if appropriate, in each case one or more narrow, merely supporting belts in addition alongside the latter.

What is claimed is:

1. A method for producing mailing bags, including envelopes, from material in web form, comprising processing the material to prepare at least two separately prepared parts (6, 7), transporting the two parts to a joining station (5), and, in the joining station, joining the two parts to one another with an adhesive, by providing the adhesive on at least one of the two parts, and then contacting the two parts one upon another thereof while moving the two parts on a carrier in an arcuate movement, such that at least one of the two parts (6, 7) and/or the carrier performs an undulating movement in the area of the joining station (5).

2. The method according to claim 1, wherein the moving of the two parts on the carrier further comprises at least one of the two parts (6, 7) and/or the carrier performing a linear movement before and/or after the joining station (5) counter to a curvature of a suction roller (8') and moving in a linear manner immediately therebefore or thereafter.

3. The method according to claim 1, wherein the moving of the two parts on the carrier further comprises at least one of the two parts (6, 7) and/or the carrier, at the joining station (5), initially moving convexly relative to a trough (16) and then concavely along the trough (16) and finally, again, convexly relative to the trough (16).

4. The method according to claim 1, wherein the contacting of the two parts comprises pressing the two parts (6, 7) simultaneously against one another at the joining station (5).

5. The method according to claim 1, further comprising using prestressed conveyor belts (11) as the carrier for at least one of the two parts (6, 7) and as a contact pressure tool.

6. The method according to claim 5, wherein the conveyor belts are dipping conveyor belts, and wherein the moving comprises moving the dipping conveyor belts (11) in the form of a concave arc.

7. An apparatus for producing mailing bags, including envelopes, from material in web form, comprising a plurality of structural groups to process the material so as to prepare therefrom at least two separately prepared parts (6, 7), to transport the two parts on a carrier to a junction station (5), to provide an adhesive on at least one of the two parts, and to join the two parts to one another with the adhesive at the junction station, wherein, at the junction station (5), at least one of the two parts and/or the carrier is briefly moved in an undulating manner.

8. The apparatus according to claim 7, wherein the junction station (5) is so adapted to press the two parts (6, 7) one upon the other at the junction station (5).

9. The apparatus according to claim 7, wherein, at the junction station (5), the carrier comprises a suction device (8) as a first carrier for a first one of the two parts (6) and a suction belt conveyor device (9) as a second carrier for a second one of the two parts (7).

10. The apparatus according to claim 9, wherein the suction device (8) comprises a suction roller (8') as the first carrier for the first part (6), and wherein the suction belt conveyor device (9) comprises conveyor belts (11) moving over at least one suction box (10) as the second carrier for the second part (7).

11. The apparatus according to claim 10, wherein the suction belt conveyor device (9) is provided as the second carrier for the second part (7) and as a counter-tool for the suction roller (8').

12. The apparatus according to claim 10, wherein the suction box (10) has slits (15', 15") in a cover plate (15) thereof supporting the conveyor belts (11).

13. The apparatus according to claim 10, wherein the conveyor belts (11) move along an arcuate path in the area of the suction roller (8'), which further serves as a bonding cylinder.

14. The apparatus according to claim 10, wherein the conveyor belts (11) are prestressed.

15. The apparatus according to claim 10, further comprising a trough (16) provided at the junction station (5) in a top (14) of the suction box (10), which top (14) guides and supports the conveyor belts (11).

16. The apparatus according to claim 15, wherein the trough (16) is allocated to the suction roller (8').

17. The apparatus according to claim 15, wherein the trough (16) is shallow.

18. The apparatus according to claim 15, wherein the trough (16) has a cross-sectional shape of a segment of a circle.

19. The apparatus according to claim 15, wherein the trough (16) has a contour that is curved parallel to a circumference (17) of the suction roller (8').

20. The apparatus according to claim 15, wherein the trough (16) has a maximum depth of approximately 1.5 to 2 mm opposite the top (14) of the suction box (10) carrying the conveyor belts (11).

21. The apparatus according to claim 15, wherein the suction roller, the conveyor belts (11) and the trough (16) are so dimensioned that the conveyor belts (11), in a position of rest, lie tangentially on the suction roller (8') without dipping into the trough (16).

22. The apparatus according to claim 15, wherein the conveyor belts (11) and the trough (16) are so dimensioned that the conveyor belts (11) do not touch a bottom (19) of the trough when the two parts (6, 7) lie one upon the other.

23. The apparatus according to claim 15, wherein the conveyor belts are dipping conveyor belts (11) that move first convexly, then concavely and then convexly again relative to the trough (16).

24. The apparatus according to claim 15, wherein a length A of the trough (16) in a direction of movement of the conveyor belts (11) is significantly shorter than a diameter of the suction roller (8').

* * * * *